US005977463A

United States Patent [19]

Bartlett

[11] Patent Number: 5,977,463

[45] Date of Patent: Nov. 2, 1999

[54] TUNING MECHANISM FOR A DRUM

[76] Inventor: Robert Orion Bartlett, 1252-A Thrasher Pike, Hixson, Tenn. 37343-3022

[21] Appl. No.: 09/102,271

[22] Filed: Jun. 22, 1998

[51] Int. Cl.[6] ..... G10D 13/02

[52] U.S. Cl. ..... 84/413

[58] Field of Search ..... 84/413, 419

[56] References Cited

U.S. PATENT DOCUMENTS

| | | | |
|---|---|---|---|
| 4,154,136 | 5/1979 | McIntyre . | |
| 4,334,458 | 6/1982 | Grauso . | |
| 4,428,272 | 1/1984 | Andre et al. | 84/413 |
| 4,570,526 | 2/1986 | Hoshino . | |
| 4,869,146 | 9/1989 | Bonsor . | |
| 4,903,569 | 2/1990 | Kurosaki | 84/413 |
| 4,928,566 | 5/1990 | Yanagisawa . | |
| 4,967,634 | 11/1990 | Whynott . | |
| 5,157,212 | 10/1992 | Fleming . | |
| 5,208,412 | 5/1993 | Hoshino . | |
| 5,410,938 | 5/1995 | Kurosaki et al. . | |
| 5,442,988 | 8/1995 | Mayo . | |
| 5,546,841 | 8/1996 | Chen . | |
| 5,561,255 | 10/1996 | Sassmannshausen et al. | 84/413 |

FOREIGN PATENT DOCUMENTS 0 194 834 9/1986 European Pat. Off. .

*Primary Examiner*—Jeffrey W. Donels

*Attorney, Agent, or Firm*—Chambliss, Bahner & Stophel, P.C.

[57] ABSTRACT

A percussion-type drum assembly is disclosed including a generally cylindrical shell which is open at both ends and has a sidewall that defines an inner diameter and an outer diameter. A generally circular centering ring is also provided. The centering ring has a diameter that is larger than the outer diameter of the shell and is adapted to be disposed around the exterior of the sidewall of the shell without making contact with the shell. The drum assembly also includes a pair of membrane mounting and tuning assemblies, one for each end of the shell. Each of these assemblies includes a membrane that is adapted to cover an open end of the shell in a desired state of tension, and which has a diameter that is at least as large as the outer diameter of the shell. Each membrane mounting and tuning assembly also includes a generally circular rim having a diameter that is at least as large as the outer diameter of the shell. The rim is adapted to fit over an end of the shell with the membrane disposed between the shell and the rim so that the rim does not contact the sidewall of the shell. Each assembly also includes a plurality of tuning lugs, each of which is adapted for attachment between the rim and the centering ring without making contact with the shell and for adjustably changing the distance between the rim and the ring so that the desired state of tension in the membrane may be maintained. A method for adjusting the tension in the membranes of the drum is also disclosed.

17 Claims, 4 Drawing Sheets

TUNING MECHANISM FOR A DRUM

FIELD OF THE INVENTION

This invention relates generally to drum-type percussion instruments, and more particularly to a mechanism for tuning or tensioning the drum heads to modify the sound produced by a drum.

BACKGROUND AND DESCRIPTION OF THE PRIOR ART

Drum-type percussion instruments, such as bass drums and the like, typically comprise a hollow cylindrical drum shell with a vibratory membrane or drum head stretched tightly over each end to define a resonant cavity within the shell. When a drum head is struck, it vibrates with a particular resonance, and this vibration is transmitted to the air within and outside of the cavity, as well as through the shell. The sum of these vibrations is perceived as the sounds produced by the drum.

Each of the drum heads has a larger diameter than the shell so that it may overlap the outer periphery of the shell and be secured against the periphery by a hoop or rim that fits tightly over the end of the shell. Typically, the rims are bolted or otherwise affixed to the drum shell, or to a bracket that is affixed to the shell. A disadvantage of this type of arrangement is that attachment of the rim to the shell, especially by use of securing bolts that pass through the shell wall, will adversely affect the quality of the sound produced by the drum.

With the passage of time and as a drum is play, the tension of the drum heads on the shell may change by stretching of the vibratory membrane or loosening of its attachment to the shell. This change in tension will affect the sound produced, and will make it necessary to adjust the tension in the membrane or "tune" the drum to obtain the desired degree of tension, and consequently, the desired sound which the drum can produce. Typically, this tuning of a drum head is accomplished by tightening the mechanism which attaches the drum head to the shell. It is not unusual for tuning of the drum heads to be required frequently throughout the useful life of the membrane.

Various drum head attachment and tuning mechanisms have been devised. Thus, for example, U.S. Pat. No. 4,154,136 of McIntyre describes a tension adjusting system for a drum that operates on a cam action principle. This system includes tension bands and tension adjusting mechanisms that are connected to the shell by a plurality of bolts. U.S. Pat. Nos. 4,570,526 and 5,208,412 of Hoshino, and U.S. Pat. No. 4,928,566 of Yanagisawa describe other types of tension application and adjusting mechanisms that are attached by means of brackets that are bolted onto and through the drum shell. Unfortunately, the securing bolts for these adjusting mechanisms or for the brackets to which they are attached pass through the shell wall, which adversely affects the quality of the sound produced by the drum. In addition, the application of tension forces at a plurality of points around the periphery of the vibratory membrane will serve to tension or tighten the membrane in a non-uniform manner, thus creating areas in the membrane that are in different states of tension, and therefore not in the same tune.

Recognizing the disadvantages inherent in attaching the tensioning and adjusting mechanisms through the shell wall of the drum, several systems have been developed for applying tension between the upper and lower rims along a plurality of external tension rods that are mounted between the rims, but are not attached through the wall of the drum shell. Among the systems of this type are those described in U.S. Pat. No. 4,334,458 of Grauso, U.S. Pat. No. 4,869,146 of Bonsor, U.S. Pat. No. 4,967,634 of Whynott, U.S. Pat. No. 5,410,938 of Kurosaki et al., U.S. Pat. No. 5,546,841 of Chen and European Patent Application Publication No. 0194834A2. Each of these systems includes upper and lower rims that project radially outwardly from the shell of the drum. Between these rims are mounted internally threaded tension rods which are attached to the upper and lower rims, or to auxiliary rims that are attached to the upper and lower rims, with bolts. By adjusting the depth of the upper and lower sets of bolts into the tension rods, tension is applied along the tension rods between the upper and lower rims. The application of tension between the upper and lower rims transmits tuning forces between the two rims. Thus, when the bolts through the upper rims are adjusted, not only is the tension in the upper drum head affected, but also the tension in the lower one. Furthermore, the application of tension forces at a plurality of opposed points around the peripheries of the vibratory membranes will also create areas in each of the membranes that are in different states of tension, and therefore not in the same tune. These effects make it quite difficult to properly tune and maintain the tension in both of the membranes of a drum equipped with one of these systems.

Although all of these tension rod systems operate according to the same general principles, they each include unique variations, as well. Thus, for example, the system of Grauso includes a suspension band to which each of the tension rods is bolted. This suspension band encircles the outer surface of the shell approximately midway between the top and bottom of the drum, and is provided with a spacer ring that fits within a channel in the outer surface of the shell. Although the tension application and adjusting mechanism of Grauso is not bolted to and through the shell, it does directly contact it, which contact would produce a deadening effect on the vibrations being transmitted through the shell as the drum is played. The system of Bonsor includes an intermediate hoop which is mounted atop the shell and bolted to the upper rim and to which the tension rods are attached. This system reportedly allows for some independent adjustment of the upper and lower membranes, but because the intermediate hoop is directly mounted on the shell, the transmission of vibrations through the shell wall will be adversely affected. The system of U.S. Pat. No. 5,410,938 of Kurosaki et al. employs a pair of suspension rings that are similar to the single intermediate hoop of Bonsor. Each of these rings is attached to the shell at one end and the tension rods are attached therebetween. The upper and lower rims are bolted to one of the suspension rings. However, because the suspension rings are directly mounted on the shell, the transmission of vibrations through the shell wall will be adversely affected.

U.S. Pat. No. 5,442,988 of Mayo also describes a drum with a tensioning and adjusting system that applies tension between the upper and lower rims. In this system, however, the tension is applied along a plurality of pairs of tension rods that are connected through adjustment mechanisms that are mounted on the side of the drum shell between the upper and lower rims. This adjusting mechanism comprises a nonreversing gear that is attached to a threaded cylinder. The nonreversing gear is turned by a worm gear or a pinion gear which is connected to a knob that extends from the side of the adjusting mechanism. Although this mechanism may provide advantages over the combination of bolts threaded into a tension rod at each end, it nevertheless transmits tension between the upper and lower rims. Furthermore, the adjusting mechanisms of Mayo are attached to the shell of the drum, which attachment will deaden the vibrations being transmitted through the shell as the drum is played.

OBJECTS AND ADVANTAGES OF THE INVENTION

Therefore, it is an object of the invention claimed herein to provide an apparatus for adjusting the tension in the vibratory membranes of a drum without requiring the attachment of any mechanism to the drum shell. It is another object of the invention to provide such an apparatus that does not apply tension forces between the upper and lower rims of a drum. Still another object of this invention is the provision of an apparatus that will produce more uniformly distributed tension in the drum heads than may be obtained by conventional tuning and tensioning mechanisms. Another object of this invention is to provide a method by which the tension in the vibratory membranes of a drum may be applied and maintained without applying tension forces between the upper and lower rims. It is yet another object of the invention to provide a drum assembly in which the only components making direct contact with the drum shell are the vibratory membranes.

Additional objects and advantages of this invention will become apparent from an examination of the drawings and the ensuing description.

SUMMARY OF THE INVENTION

The invention comprises a drum including a generally cylindrical shell which is open at both ends and which has a sidewall that defines an inner diameter and an outer diameter. The drum also includes a generally circular centering ring having a diameter that is larger than the outer diameter of the shell. The centering ring is disposed around the exterior of the sidewall of the shell without making contact therewith. A pair of membrane mounting and tuning assemblies are also included, one for each end of the shell. Each of these assemblies includes a membrane which is adapted to cover an open end of the shell in a desired state of tension. The membrane has a diameter that is at least as large as the outer diameter of the shell. Each of the membrane mounting and tuning assemblies also includes a generally circular rim having a diameter that is at least as large as the outer diameter of the shell. This rim is adapted to fit over an end of the shell with the membrane disposed therebetween so that the rim does not contact the sidewall of the shell. Each assembly also includes a plurality of tuning lugs, each of which is adapted for attachment between the rim and the centering ring without making contact with the shell and for adjustably changing the distance between the rim and the ring so that the desired state of tension in the membrane may be maintained. A membrane is stretched across each end of the shell with a rim disposed thereover, and with each rim adjustably attached to a centrally disposed centering ring by a plurality of tuning lugs.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DEFINITIONS OF CERTAIN TERMS

As used herein, the term "generally cylindrical shell" includes shells that are comprised of right circular cylinders, as well as those comprised of other cylinders and truncated cones, and those having cross-sections that are elliptical, hexagonal, octagonal, or of other similar shape.

As used herein, the term "generally circular centering ring" includes rings that are circular, elliptical, hexagonal, octagonal, or of other similar shape.

DESCRIPTION OF THE PREFERRED EMBODIMENTS OF THE INVENTION

Figure 1:
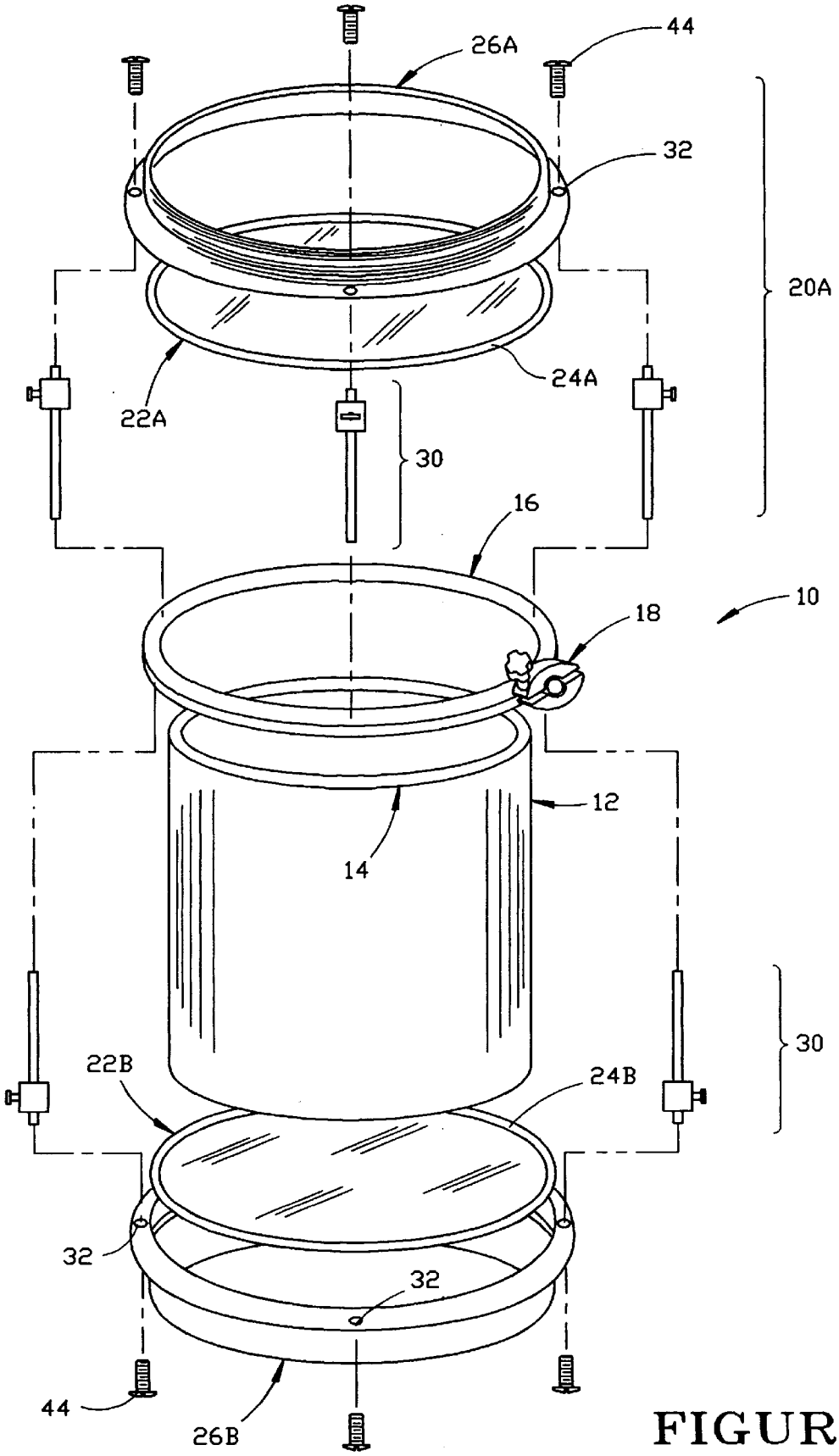
FIG. 1 is an exploded perspective view of a drum that is constructed according to a preferred embodiment of the invention.

Referring now to the drawings, drum assembly 10 is comprised of a generally cylindrical shell 12 which is open at both ends. Shell 12 has a sidewall 14 which defines an inner diameter and an outer diameter of the shell. Also included in assembly 10 is generally circular centering ring 16, which has a diameter that is larger than the outer diameter of the shell, so that centering ring 16 may be placed around the exterior of the sidewall of the shell 12 without making contact with the shell. Centering ring 16 may be provided in metal, plastic or other convenient material. Preferably, centering ring 16 is made from steel. It may also be chrome plated or otherwise provided with an attractive finish. In the preferred embodiment of FIG. 1, centering ring 16 is also provided with conventional drum mount 18, which may be used to mount the drum assembly on a support stand. Although not required, mount 18 may be welded or otherwise attached to the centering ring at any convenient location.

Drum 10 also includes a pair of membrane mounting and tuning assemblies 20, one for each end of the shell. Each of mounting and tuning assemblies 20 includes a membrane which is adapted to cover an open end of the shell in a desired state of tension. In the drawings, the components of the tuning assembly that is illustrated at the top of shell 12, as viewed in FIG. 1, will be identified with an "A" and the components of the tuning assembly that is shown at the bottom of shell 12 are identified with a "B". Thus, assembly 20A includes membrane 22A which has a diameter that is at least as large as the outer diameter of shell 12. Preferably, membranes 22A and 22B are of the conventional type having a membrane ring 24 around the periphery thereof to provide a more secure attachment on shell 12. The membrane ring has an inner diameter that is at least as large as the outer diameter of the shell.

Figure 2:
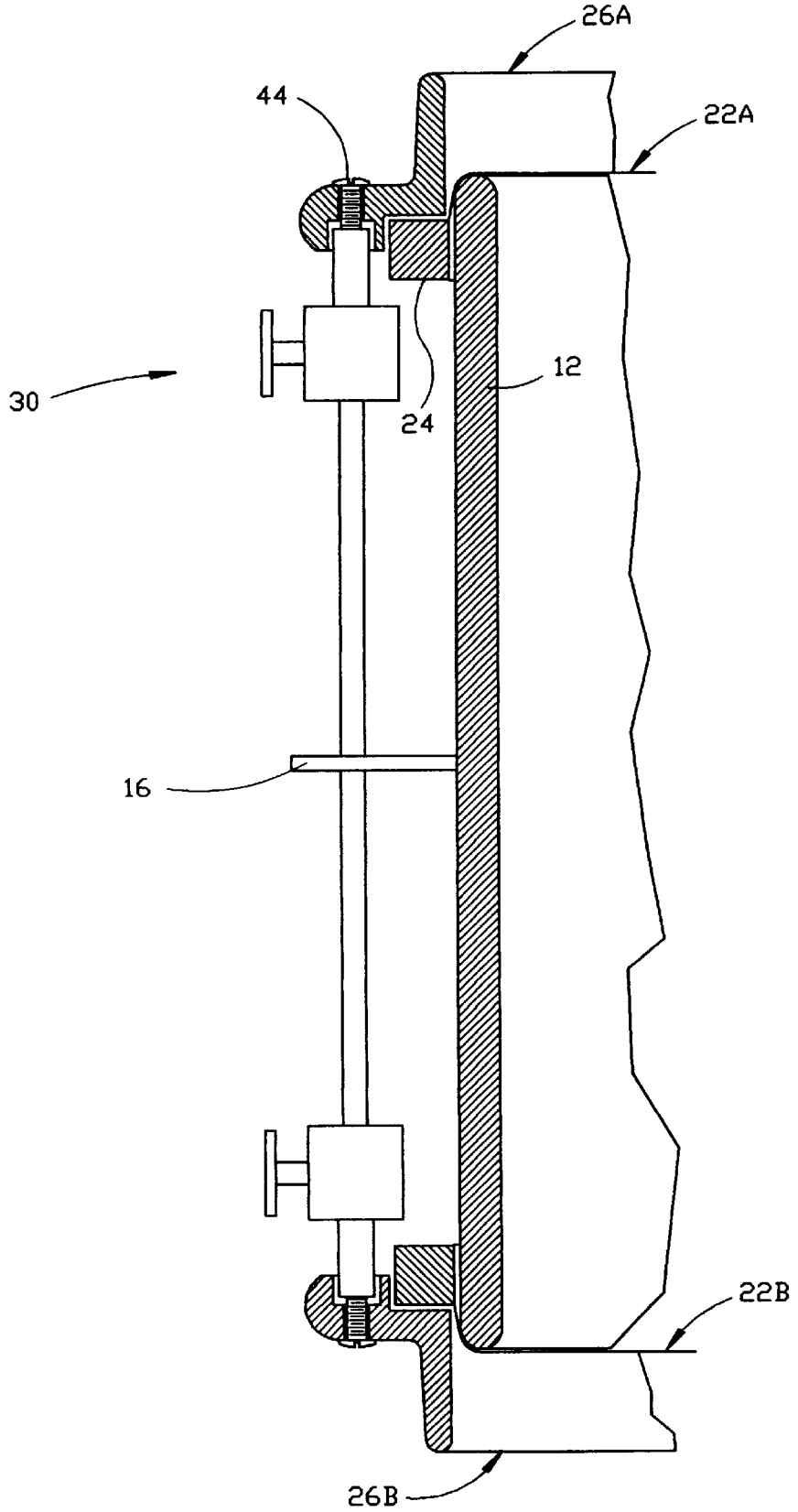
FIG. 2 is a partial sectional view of the drum of FIG. 1.
Figure 3:
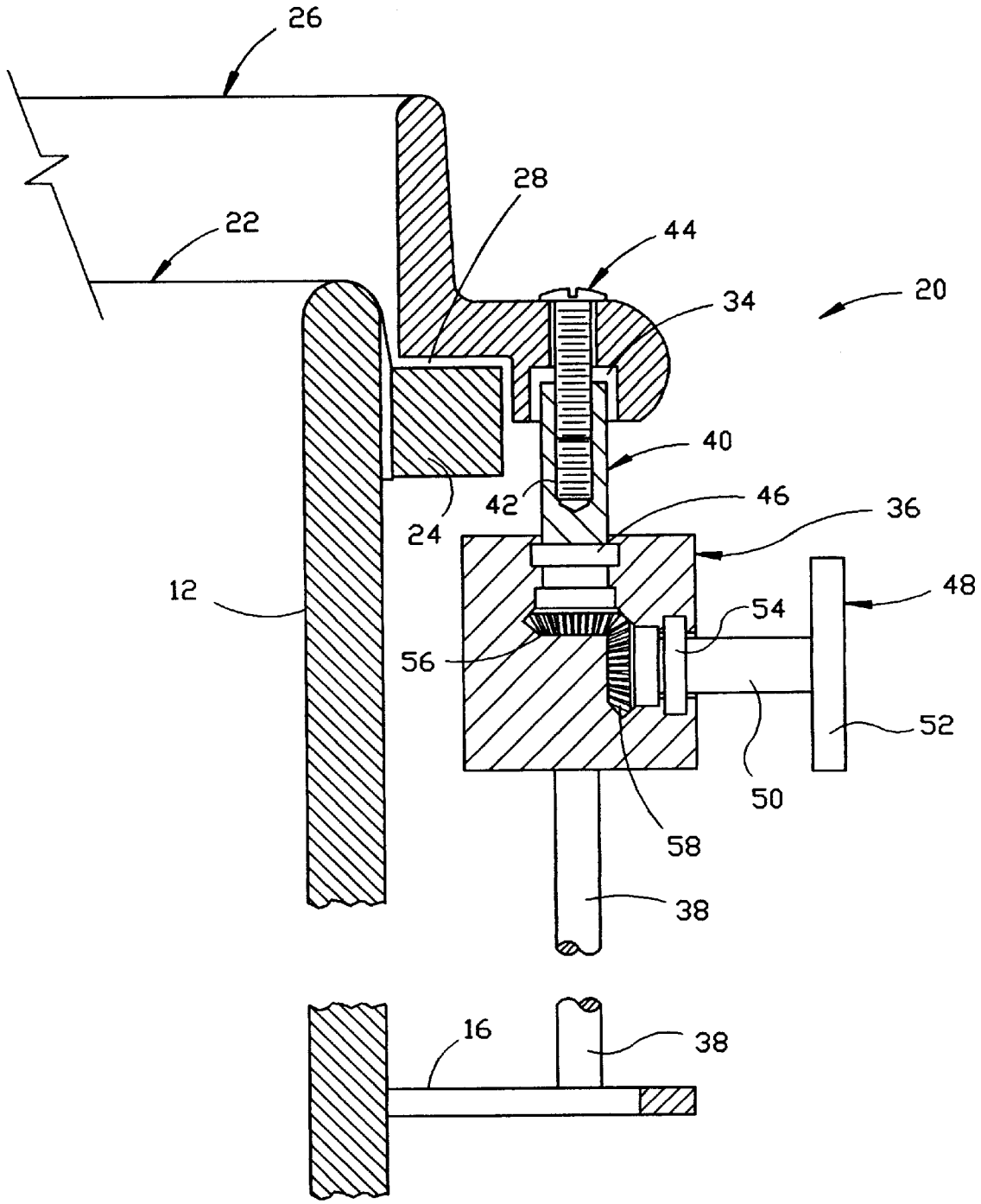
FIG. 3 is a sectional view of a portion of the drum of FIG. 2, showing the details of a first embodiment of a membrane mounting and tuning assembly of the invention.
Figure 4:
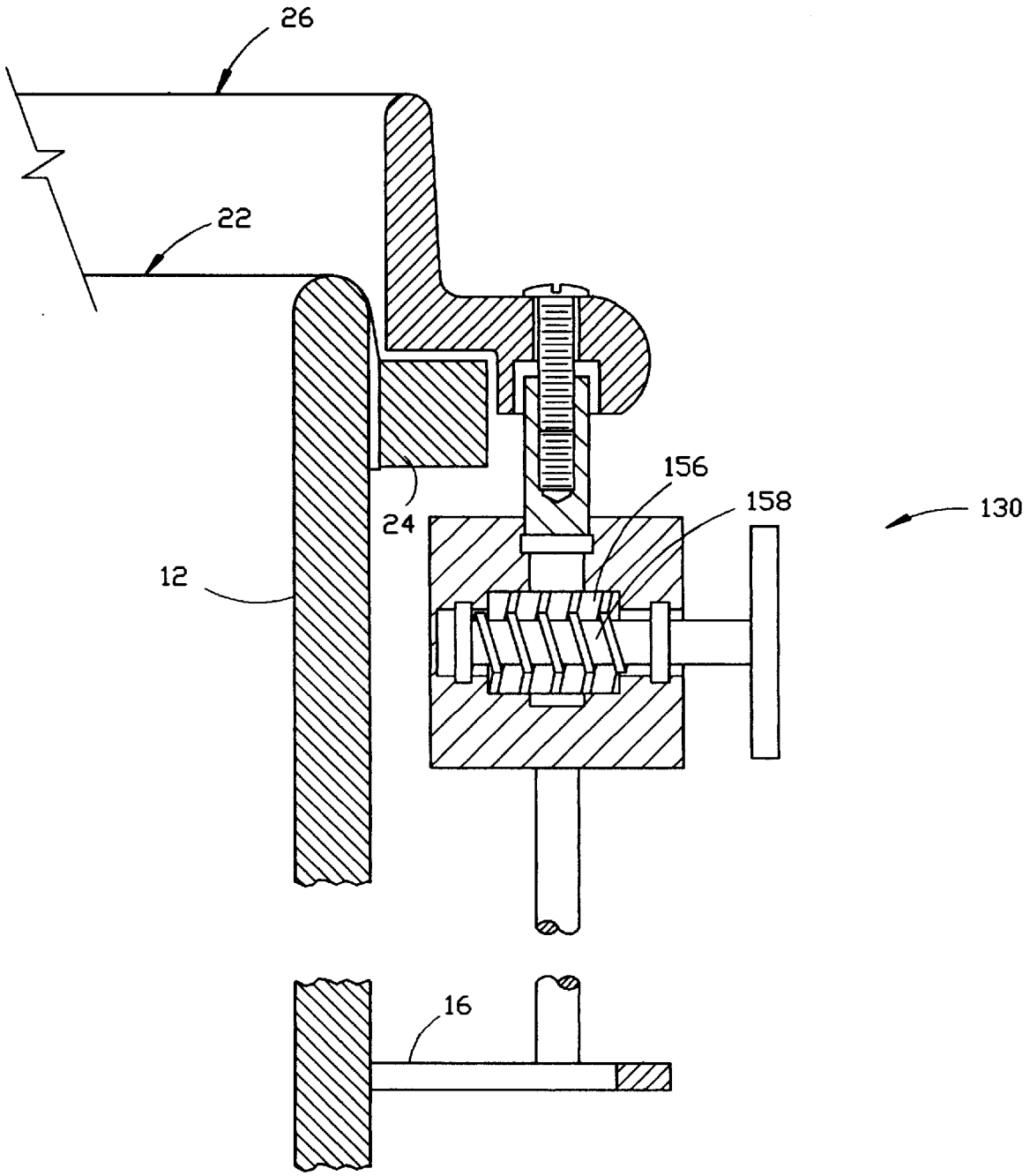
FIG. 4 is a sectional view of a portion of the drum of FIG. 2, showing the details of a second embodiment of a membrane mounting and tuning assembly of the invention.

Each of assemblies 20 also includes a generally circular rim 26 which has a diameter that is at least as large as the outer diameter of shell 12. As shown in FIGS. 2 through 4, rim 26 is adapted to fit over an end of the shell with the membrane disposed therebetween so that the rim does not contact the sidewall of the shell. Preferably rim 26 includes annular recess 28 which engages ring 24 of membrane 22 when assembly 20 is secured on the shell. By placing the membrane ring in contact with the rim of its associated mounting and tuning assembly, the state of tension in the membrane may be changed, in a manner to be subsequently explained, by changing the relative location of the membrane ring with respect to the shell.

Assembly 20 also includes a plurality of tuning lugs 30, each of which is adapted for attachment between the rim and the centering ring without making contact with the shell. Tuning lugs 30 are also adapted for adjustably changing the distance between rim 26 and ring 16 so that the desired state of tension in the membrane may be maintained.

Preferably, rim 26 of each membrane mounting and tuning assembly 20 has a plurality of fastener holes 32 spaced therearound, that are located outside the sidewall of the shell, for attachment of lugs 30. It is also preferred that rim 26 include a plurality of lug recesses 34, each of which is coaxially aligned with a fastener hole.

Each of preferred tuning lugs 30 includes a lug body 36 and a connecting rod 38, which is attached to centering ring 16. Rod 38 may be welded into place on the centering ring, or it may be internally threaded and bolted thereto, or attached by other convenient method.

As shown in FIG. 3, tuning cylinder 40 of lug body 36 is provided with a threaded hole 42 which is adapted to be aligned with one of the holes 32 in the rim for attachment thereto by means of fastener 44, which is threaded so as to mate with the threads of hole 42. In this way, tuning cylinder 40 may be attached to the rim at one end of the drum shell. Preferably, fastener 44 is also threaded to mate with the threads of fastener hole 32, so that the fastener may be tightened down and secured to rim 26 so as to preclude further rotation of fastener 44.

Tuning cylinder 40 is mounted for rotation within the lug body and is preferably restrained from axial motion within the lug body by collar 46. Tuning lug 30 also includes tuning key 48 which is comprised of shaft 50 and grip 52. Shaft 50 is adapted for radial motion about its long axis within the lug body, and is preferably restrained from axial motion within the lug body by collar 54. Preferably, the shaft of the tuning key of tuning lug 30 is oriented at approximately a right angle to the axis of the tuning cylinder, as shown in FIG. 3. Grip 52 is attached to the shaft and is manually accessible from the exterior of the lug body.

Tuning lug 30 also includes a translation mechanism which is adapted for translating rotary motion of the shaft of the key into axial motion of the tuning cylinder (along its long axis) with respect to the rim. Preferably, the translation mechanism includes a first gear on the tuning cylinder, and a second gear on the shaft of the key that is adapted to engage with the first gear. As shown in FIG. 3, these gears may be provided in the form of bevel gear 56 (on the tuning cylinder) and mating bevel gear 58 (on the shaft of the key). FIG. 4 shows an alternative embodiment 130 of the tuning lug of the invention, in which the translation mechanism comprises a nonreversing gear 156 on the tuning cylinder that is engaged by a worm gear 158 on the shaft of the key. In all other respects, tuning lug 130 is identical with lug 30.

Referring again to FIG. 3, it can be seen that the internal threads in cylinder 40 are provided in greater depth than the length of fastener 44. This permits fastener 44 to be threaded through a hole in rim 26 and to engage a portion of the internal threads in cylinder 40. In addition, lug recess 34 is adapted to receive a portion of tuning cylinder 40 and to permit said portion to move axially therein as the translation mechanism is engaged by rotary motion of the shaft of the key. As shaft 50 is turned by means of key 48, bevel gear 58 will turn bevel gear 56, thus rotating cylinder 40 about fastener 44. This will permit cylinder 40 to move axially within lug recess 34, thus moving tuning lug 30 with respect to rim 26 along the long axis of the tuning cylinder and thereby changing the distance between rim 26 and centering ring 16. As tuning lug 30 is moved with respect to rim 26, the state of tension in membrane 22 may be changed by changing the relative location of membrane ring 24 with respect to shell 12.

It is preferred that at least four, and more preferably eight, tuning lugs are provided in each assembly 20, although such number are not illustrated in the drawings for purposes of clarity. It is also preferred that the tuning lugs that are attached between the centering ring and the rim at one end of the drum shell are offset from the tuning lugs that are attached between the centering ring and the rim at the other end of the drum shell. In such embodiment, connecting rods 38B will not be attached to ring 16 directly opposite connecting rods 38A, but will be spaced therefrom. Preferably, the connecting rods will be spaced so that an equal distance is maintained between the point of attachment of a connecting rod 38B of assembly 20B on centering ring 16 and the points of attachment of two adjacent connecting rods 38A of assembly 20A. It is also preferred that the connecting rods in each tuning assembly be equally spaced around the periphery of the drum.

The invention distributes the tensioning and tuning forces that are applied to membrane 22A between rim 26A and the centering ring instead of between rims 26A and 26B. Similarly, it distributes the tensioning and tuning forces that are applied to membrane 22B between rim 26B and the centering ring instead of between rims 26A and 26B. Consequently, the invention may be utilized to provide uniformly distributed tension in the drum heads. Finally, the invention also provides a drum assembly in which the only components making direct contact with the drum shell are the vibratory membranes, thus avoiding the distortion and dampening effect of attachments to or through the shell of the drum.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A drum comprising:

(a) a generally cylindrical shell which is open at both ends, said shell having a sidewall which defines an inner diameter and an outer diameter;

(b) a generally circular centering ring having a diameter that is larger than the outer diameter of the shell, said centering ring being adapted to be disposed around the exterior of the sidewall of the shell without making contact therewith;

(c) a pair of membrane mounting and tuning assemblies, one for each end of the shell, each of said assemblies comprising:

(i) a membrane which is adapted to cover an open end of the shell in a desired state of tension, said membrane having a diameter that is at least as large as the outer diameter of the shell;

(ii) a generally circular rim having a diameter that is at least as large as the outer diameter of the shell, said rim being adapted to fit over an end of the shell with the membrane disposed therebetween so that said rim does not contact the sidewall of the shell;

(iii) a plurality of tuning lugs, each of which is adapted for attachment between the rim and the centering ring without making contact with the shell and for adjustably changing the distance between said rim and said ring so that the desired state of tension in the membrane may be maintained;

whereby a membrane may be stretched across each end of the shell and a rim disposed thereover with each rim being adjustably attached to a centrally disposed centering ring by a plurality of tuning lugs.

2. The drum of claim 1 wherein a drum stand attachment is affixed to the centering ring.

3. The drum of claim 1 wherein each membrane includes a membrane ring disposed therearound and attached at the periphery thereof, said membrane ring having an inner diameter that is at least as large as the outer diameter of the shell, and wherein each membrane ring is contacted by a rim of its associated mounting and tuning assembly so that by changing the distance between said rim and the centering ring, the relative location of the membrane ring with respect to the shell may be changed so as to change the state of tension in the membrane.

4. The drum of claim 1 wherein the tuning lugs that are attached between the centering ring and the rim at one end of the drum shell are offset from the tuning lugs that are attached between the centering ring and the rim at the other end of the drum shell.

5. The drum of claim 1 wherein the rim of each membrane mounting and tuning assembly has a plurality of holes spaced therearound that are located outside the sidewall of the shell, and wherein each tuning lug is provided with a hole that is adapted to be aligned with a hole in the rim so that a fastener may be inserted through the hole in the rim into the tuning lug for attachment of the tuning lug to the rim.

6. The drum of claim 5 wherein each tuning lug comprises:

(a) a lug body;

(b) a tuning key having:

(i) a shaft which is adapted for radial motion about its long axis within the lug body; and (ii) a grip that is attached to the shaft and manually accessible from the exterior of the lug body;

(c) a tuning cylinder that is adapted for attachment to the rim at one end of the drum shell, said tuning cylinder being mounted for rotation within the lug body and being adapted to move the lug body with respect to the rim along the long axis of the tuning cylinder;

(d) a translation mechanism which is adapted for translating rotary motion of the shaft of the key into axial motion of the tuning cylinder with respect to the rim; and (e) a connecting rod that is attached to the centering ring.

7. The drum of claim 6 wherein the shaft of the tuning key of each tuning lug is oriented at approximately a right angle to the axis of the tuning cylinder.

8. The drum of claim 6 wherein each of the rims is provided with a plurality of lug recesses, each of which is coaxially aligned with a fastener hole and is adapted to receive a portion of the tuning cylinder and to permit said portion to move axially therein, and wherein each of said tuning cylinders is internally threaded so as to mate with a fastener, said threads in said cylinder being of such depth that a fastener inserted into a hole in the rim may engage the threads of a tuning cylinder, so that the tuning cylinder may be moved axially within the recess as the translation mechanism is engaged by rotary motion of the shaft of the key.

9. The drum of claim 6 wherein the translation mechanism of each lug includes a first gear on the tuning cylinder, and a second gear on the shaft of the key that is adapted to engage with the first gear.

10. The drum of claim 9 wherein the translation mechanism of each lug includes a pair of bevel gears.

11. A drum comprising:

(a) a generally cylindrical shell which is open at both ends, said shell having a sidewall which defines an inner diameter and an outer diameter;

(b) a generally circular centering ring having a diameter that is larger than the outer diameter of the shell, said centering ring being adapted to be disposed around the exterior of the sidewall of the shell without making contact therewith;

(c) a pair of membrane mounting and tuning assemblies, one for each end of the shell, each of said assemblies comprising:

(i) a membrane which is adapted to cover an open end of the shell in a desired state of tension, said membrane having a diameter that is at least as large as the outer diameter of the shell and including a membrane ring disposed around and attached at the periphery thereof, said membrane ring having an inner diameter that is at least as large as the outer diameter of the shell;

(ii) a generally circular rim having a diameter that is at least as large as the outer diameter of the shell and having an annular recess which is adapted to engage the membrane ring, said rim being adapted to fit over an end of the shell with the membrane disposed therebetween and the membrane ring in engagement with the recess so that the rim does not contact the sidewall of the shell;

(iii) a plurality of tuning lugs, each of which is adapted for attachment between the rim and the centering ring without making contact with the shell and for adjustably changing the distance between said rim and said ring so that the desired state of tension in the membrane may be maintained;

whereby a membrane may be stretched across each end of the shell and a rim disposed thereover so that the membrane ring is engaged by the annular recess of the rim and said rim does not contact the sidewall of the shell, said rim being adjustably attached to a centrally disposed centering ring by a plurality of tuning lugs, so that by changing the distance between said rim and the centering ring, the relative location of the membrane ring with respect to the shell may be changed so as to change the state of tension in the membrane.

12. The drum of claim 11 wherein the tuning lugs that are attached between the centering ring and the rim at one end of the drum shell are offset from the tuning lugs that are attached between the centering ring and the rim at the other end of the drum shell.

13. The drum of claim 11 wherein each tuning lug comprises:

(a) a lug body;

(b) a tuning key having:

(i) a shaft which is adapted for radial motion about its long axis within the lug body; and (ii) a grip that is attached to the shaft and manually accessible from the exterior of the lug body;

(c) a tuning cylinder that is adapted for attachment to the rim at one end of the drum shell, said tuning cylinder being mounted for rotation within the lug body and being adapted to move the lug body with respect to the rim along the long axis of the tuning cylinder;

(d) a translation mechanism which is adapted for translating rotary motion of the shaft of the key into axial motion of the tuning cylinder with respect to the rim; and (e) a connecting rod that is attached to the centering ring.

14. The drum of claim 13 wherein each of the rims is provided with a plurality of lug recesses, each of which is coaxially aligned with a fastener hole and is adapted to receive a portion of the tuning cylinder and to permit said portion to move axially therein, and wherein each of said tuning cylinders is internally threaded so as to mate with a fastener, said threads in said cylinder being of such depth that a fastener inserted into a hole in the rim may engage the threads of a tuning cylinder, so that the tuning cylinder may be moved axially within the recess as the translation mechanism is engaged by rotary motion of the shaft of the key.

15. The drum of claim 13 wherein the translation mechanism of each lug includes a first gear on the tuning cylinder, and a second gear on the shaft of the key that is adapted to engage with the first gear.

16. The drum of claim 15 wherein the translation mechanism of each lug includes a pair of bevel gears.

17. A method for tuning a drum comprising a generally cylindrical shell which is open at both ends, said shell having a sidewall which defines an inner diameter and an outer diameter, and a pair of membranes, each of which is adapted to cover an open end of the shell in a desired state of tension, said membranes having a diameter that is at least as large as the outer diameter of the shell, said drum including:

(a) a generally circular centering ring having a diameter that is larger than the outer diameter of the shell, said centering ring being adapted to be disposed around the exterior of the sidewall of the shell without making contact therewith;

(b) a pair of membrane mounting and tuning assemblies, one for each end of the shell, each of said assemblies including:

(i) a generally circular rim having a diameter that is at least as large as the outer diameter of the shell, said rim being adapted to fit over an end of the shell with the membrane disposed therebetween so that said rim does not contact the sidewall of the shell;

(ii) a plurality of tuning lugs, each of which is adapted for attachment between the rim and the centering ring without making contact with the shell and for adjustably changing the distance between said rim and said ring so that the desired state of tension in the membrane may be maintained;

wherein the method comprises operating the tuning lugs to change the distance between the rim and the centering ring so that the desired state of tension in the membrane may be maintained.

* * * * *